US005676425A

United States Patent [19]

Pernicka

[11] Patent Number: 5,676,425

[45] Date of Patent: Oct. 14, 1997

[54] RELEASABLE LOCK FORCHAIR CONTROL MECHANISM

[75] Inventor: Vaclav Pernicka, Bramalea, Canada

[73] Assignee: R.A.M. Machines (1990) Ltd., Concord, Canada

[21] Appl. No.: 619,451

[22] Filed: Mar. 19, 1996

[51] Int. Cl.[6] ..... B60N 2/02

[52] U.S. Cl. ..... 297/374; 297/375

[58] Field of Search ..... 297/374, 375, 297/463.1

[56] References Cited

U.S. PATENT DOCUMENTS

| | | | |
|---|---|---|---|
| 3,602,546 | 8/1971 | Tabor | 297/374 |
| 4,062,587 | 12/1977 | Wolters | 297/374 X |
| 4,198,094 | 4/1980 | Bjerknes et al. | 297/306 |
| 4,494,795 | 1/1985 | Roossien et al. | 297/355 |
| 4,570,895 | 2/1986 | Whitwam et al. | 248/575 |
| 4,636,004 | 1/1987 | Neumüller | 297/374 X |
| 4,720,142 | 1/1988 | Holdredge et al. | 297/300 |
| 5,066,069 | 11/1991 | DeGelder | 297/374 |
| 5,228,748 | 7/1993 | Neumuller | 297/374 |
| 5,328,242 | 7/1994 | Steffens et al. | 297/374 |
| 5,356,200 | 10/1994 | Stumpf et al. | 297/374 X |
| 5,423,595 | 6/1995 | Harcock | 297/374 |
| 5,560,682 | 10/1996 | Brown | 297/374 |
| 5,588,706 | 12/1996 | Neumeller et al. | 297/374 |

FOREIGN PATENT DOCUMENTS

| | | | |
|---|---|---|---|
| 2080720 | 4/1993 | Canada . | |
| 2118762 | 11/1994 | Canada . | |
| 69207 | 1/1983 | European Pat. Off. | 297/375 |
| 3513333 | 10/1986 | Germany | 297/375 |

*Primary Examiner*—Peter M. Cuomo
*Assistant Examiner*—Rodney B. White
*Attorney, Agent, or Firm*—Bereskin & Parr

[57] ABSTRACT

A chair control mechanism having compressible lamellas which when compressed lock a chair back and/or seat in position and when decompressed allow adjustment of the chair seat and/or back, and housing a releasable lock to compress and decompress the lamellas. The lock includes a U-shaped slide member slidable on the same shaft as that on which the lamellas are mounted, and having its cross member pressed against the lamellas and its free ends projecting through slots in a housing side wall. A coil spring between the side wall and connecting member biases the slide member against the lamellas to compress them. A cam connected to the legs of the slide member outside the side wall is moveable to pull the slide member outwardly through the side wall to release the pressure on the lamellas.

10 Claims, 8 Drawing Sheets

RELEASABLE LOCK FORCHAIR CONTROL MECHANISM

FIELD OF THE INVENTION

The present invention relates to a releasable lock for a chair control mechanism. The chair control mechanism is of the kind which controls the angular adjustment of the back or seat of a chair.

BACKGROUND OF THE INVENTION

Control mechanisms for chairs, which control the angular or tilt adjustment of various parts of the chair, are well known in the art. Such mechanisms are common in office chairs and normally control the inclination of the chair back or the chair seat. These mechanisms usually include a releasable lock which allows the user to lock the back or seat in a selected position which is comfortable for the individual user. In this manner the chair may be individually adjusted to the needs of many individuals.

Alternatively, the control mechanism may be placed in a released or unlocked mode, in which a biasing means (usually a spring) biases the seat or back to a predetermined position (usually an upright position). If the user exerts a sufficient force against the biasing, the seat or back seat will move accordingly. Once the user stops exerting force against the biasing, then the seat or back will return to its original position.

An example of a chair control mechanism with a releasable lock, referred to as the brake, is shown in U.S. Pat. No. 5,356,200 issued Oct. 18, 1994 to Stumpf et al (assignee Doerner Products Ltd.).

Other examples of chair control mechanisms with releasable locks are shown in U.S. Pat. No. 4,494,795 issued Jan. 22, 1985 to Roossien et al, U.S. Pat. No. 4,570,895 issued Feb. 18, 1986 to Whitwam et al, U.S. Pat No. 4,720,142 issued Jan. 19, 1988 to Holdredge et al, and U.S. Pat. No. 5,328,242 issued Jul. 12, 1994 to Steffens et al (all assigned to Steelcase Inc.).

Further examples of such mechanisms are disclosed in U.S. Pat. No. 4,636,004 issued Jan. 13, 1987 to Neumuller, and U.S. Pat. No. 4,198,094 issued Apr. 15, 1980 to Bjerknes et al.

Chair control mechanisms are commonly subjected to large forces when in use. Therefore, as will be seen from the above identified patents, they usually employ relatively complex, heavily constructed locks to lock them against moving or to release them for adjustment. These locks are relatively costly.

It is therefore desired to provide a releasable lock for a chair control mechanism, which lock is sturdy and not susceptible to breakage, and yet which at the same time is relatively inexpensive and does not require unduly large input forces from the user for operation.

BRIEF SUMMARY OF THE INVENTION

Accordingly, the invention in one of its aspects provides:

A chair control mechanism comprising:

(a) a housing, (b) a set of lamellas in said housing for connection to a chair part to allow selective movement of said chair part, said lamellas having aligned openings therein, (c) a shaft extending into said housing and through said openings in said lamellas, one end of said shaft being fixed relative to said housing, (d) a slide member slidable on said shaft and extending through said housing and having a first end adjacent said lamellas and a second end outside said housing, (e) said slide member being slidable on said shaft between a first position in which said first end applies pressure to compress said lamellas and a second position in which said first end is moved away from said lamellas to release the pressure on said lamellas, (f) biasing means biasing said slide member to said first position to compress said lamellas together, (g) and cam means connected to the second end of said slide member and operable to cam said slide member to said second position to selectively lock and unlock said lamellas.

Further objects and advantages of the invention will appear from the following description, taken together with the accompanying drawings.

DETAILED DESCRIPTION OF THE PREFERRED EMBODIMENT

Reference is next made to the drawings, which show a chair control mechanism generally indicated at 10 and having a releasable lock generally indicated at 12 and made in accordance with the invention. The chair control mechanism 10 may be used in any chair which has one or more angular adjustment features, such as an office chair, and will be described only briefly since it is entirely conventional (similar mechanisms are shown in the above referenced patents).

Figure 2:
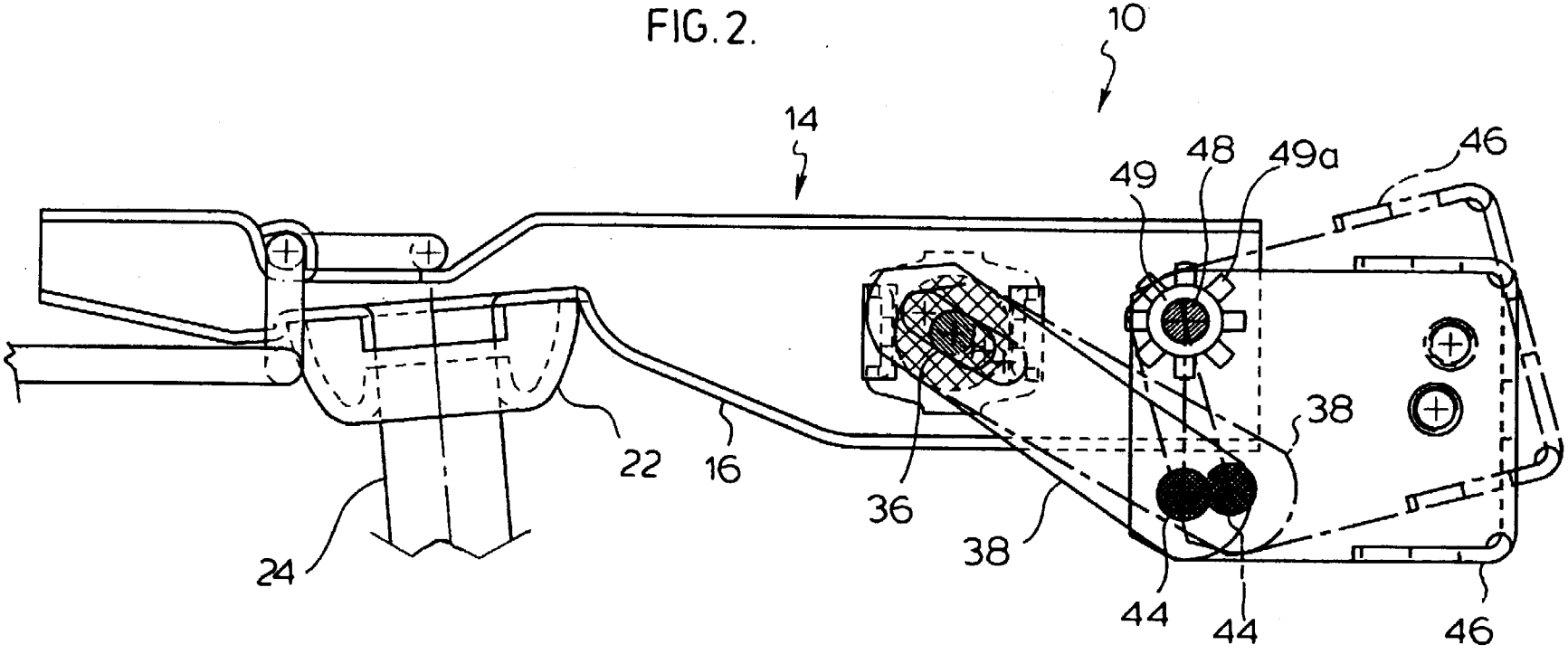
FIG. 2 is a side view, partly in section, of the FIG. 1 mechanism.

The chair control mechanism 10 includes a U-shaped housing 14, having a bottom wall 16 and a pair of upstanding side walls 18, 20. A "bell" indicated at 22 (FIG. 2) in the bottom wall 16, receives a chair spindle indicated in dotted lines at 24 (the spindle 24 is connected to the chair base, not shown).

In the embodiment shown, the housing 14 has upper flanges 26 which support a fixed seat, not shown. If desired the seat can be made to tilt rearwardly; this does not form part of the present invention.

The housing 14 further includes a shaft 36 which passes through the housing sidewalls 18, 20. A set of lamellas 38 (see also FIG. 6) is mounted on shaft 36, which passes through slots 39 in the lamellas 38. The lamellas 38 are separated by spacer or clutch discs 40, also mounted on shaft 36 (which passes through holes 41 in discs 40). The discs 40 alternate on shaft 36 with lamellas 38.

Figure 7:
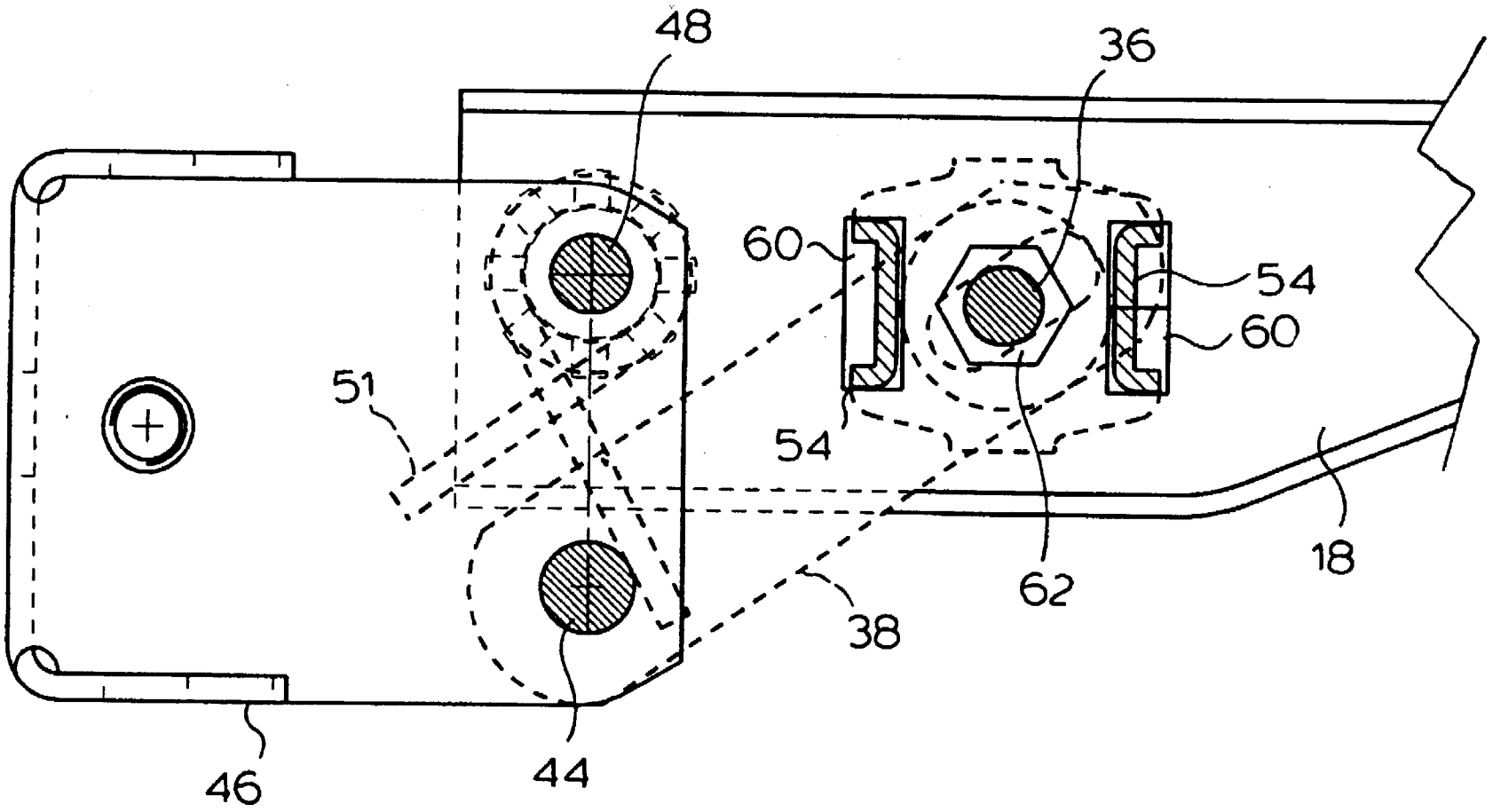
FIG. 7 is a view, partly in section, of a portion of the side wall of the housing of the mechanism, showing slots therein.

The lamellas 38 extend rearwardly and downwardly and are pivotably connected by shaft 44 to a chair back holder 46. The back holder 46 is in turn pivotally connected by shaft 48 (which is enclosed in a tubular plastic spacer 49) to the side walls 18, 20. The back holder 46 contains a slot 50 for a chaff back, not shown, and is conventionally biased by two springs, one of which is shown in dotted outline at 51 (FIGS. 3, 7), so that the chair back will normally return to an upright position. The springs 51, which are conventional, are located one on each side of raised plastic center 49*a* of spacer 49.

The above described arrangement of lamellas is well known. As is known, the lamellas, when unlocked (i.e. not compressed together) permit the chair back to tilt as desired by the user. The lamellas undergo both pivotting and translational movement during this process. In use, the lamellas are normally locked or compressed together. They are unlocked for adjustment of the chair back, and then are again locked (by compressing them together) once the desired position has been reached. It is the releasable lock 12 for locking or compressing the lamellas together with which the present invention is concerned.

In the embodiment shown, only the chair back tilts. In other cases the chair seat and back will be fixed together, and will tilt in unison, in which case again only one set of lamellas is needed. In other situations both the chair seat and chair back will tilt at differing rates, requiring two sets of lamellas. The releasable locking mechanism to be described will function in all such cases.

Figure 6:
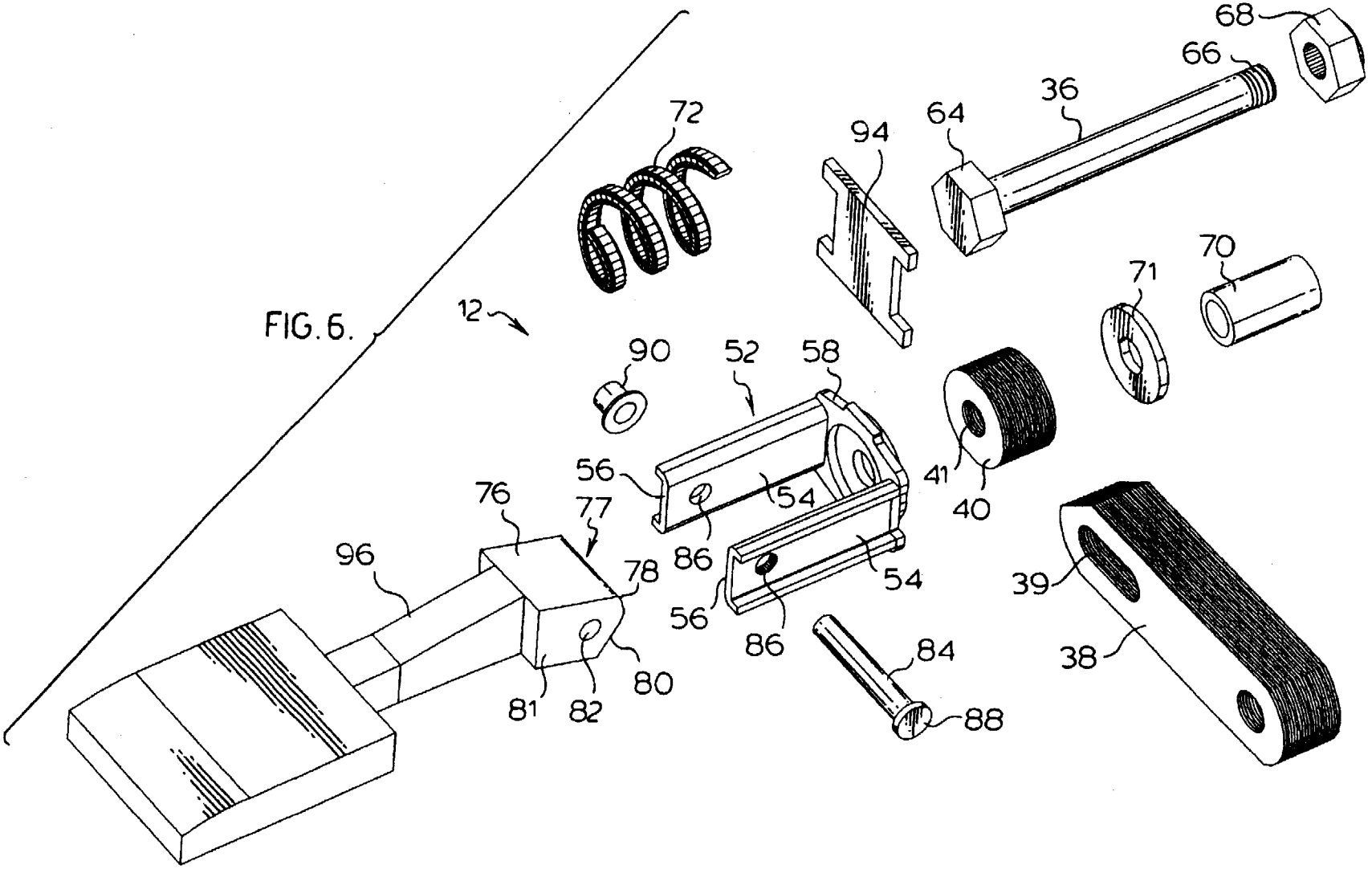
FIG. 6 is a perspective view which illustrates the various parts of the releasable lock of FIGS. 1 to 5 in a disassembled relationship.

As shown in the drawings, particularly in FIG. 6, the preferred embodiment of the releasable lock 12 includes a U-shaped slide member 52 having a pair of channel shaped side rails 54 having free ends 56, and having an integral connecting member 58 joining the rails at their inner ends. The rails 54 extend through a pair of slots 60 (FIGS. 1A, 7) in the side wall 18, and project outside the housing 14. Between the slots 60, the side wall 18 includes an opening 62 through which the shaft 36 passes. The slide member 52 is thus mounted by connecting member 58 on shaft 36, with the connecting member 58 positioned between the side walls 18, 20.

The shaft 36 includes at one end an enlarged head 64 located on the outside of side wall 18 to prevent the shaft from being pushed through the opening 62. The other end of shaft 36 contains a screw thread 66 which holds a nut 68 which in turn holds a tubular spacer 70 on shaft 36. The spacer 70, which passes through side wall 20, presses at its inner end against a washer 71 on shaft 36. The washer 71 prevents movement of the lamellas 38 and discs 40 towards side wall 20.

Figure 3:
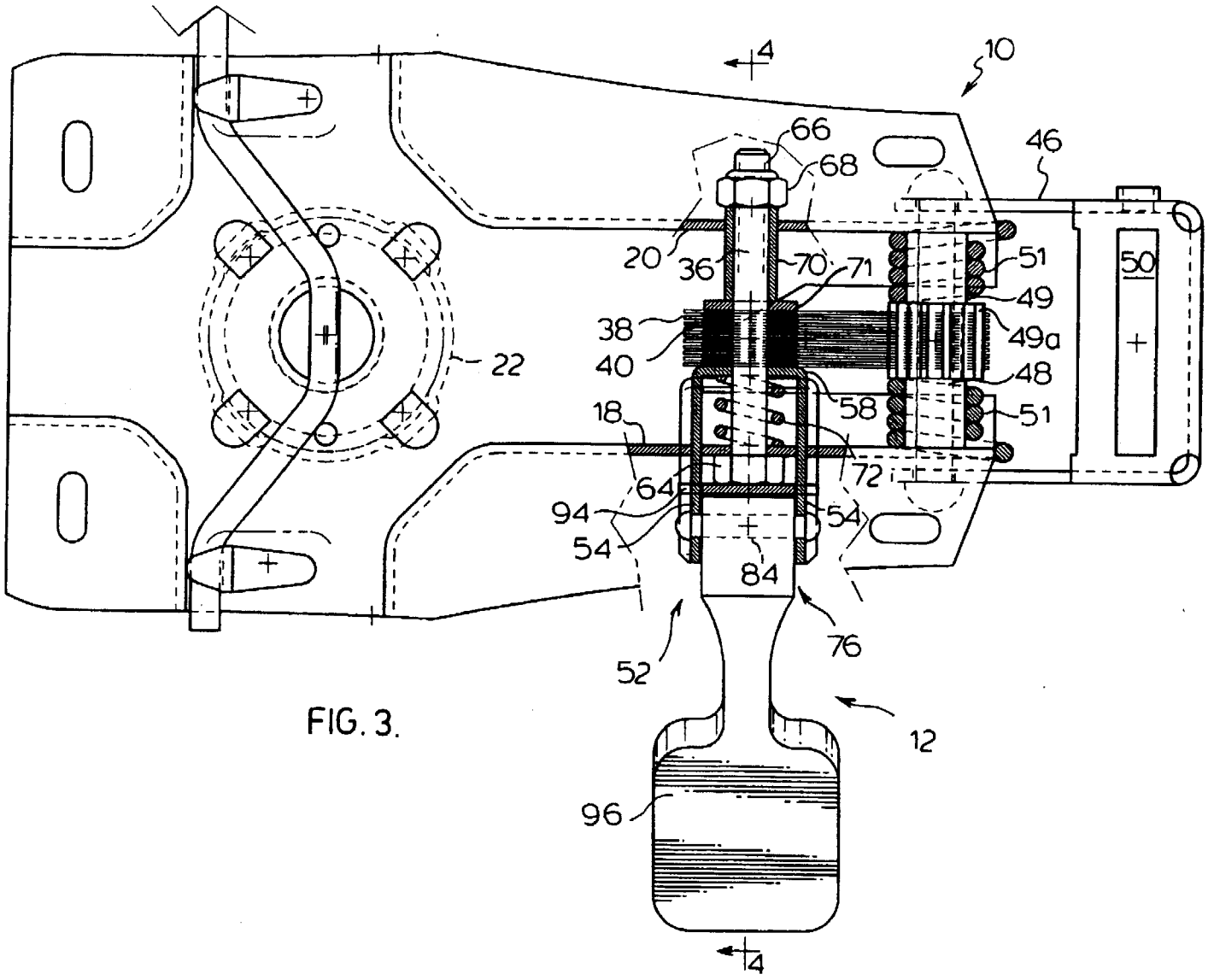
FIG. 3 is a top plan view of the FIG. 1 mechanism.
Figure 4:
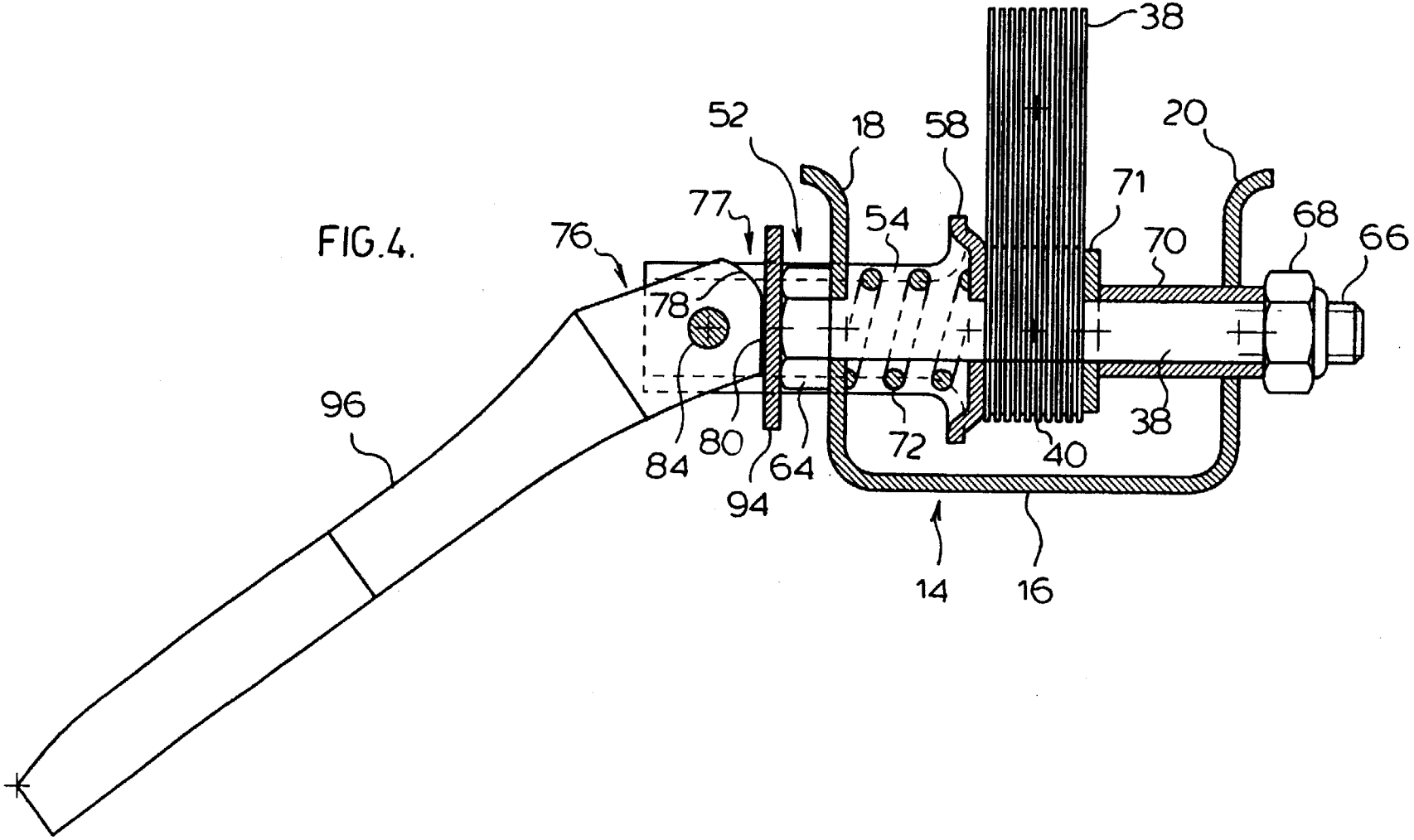
FIG. 4 is a cross-sectional view taken along lines 4—4 of FIG. 3 with the control mechanism in the locked position.

The connecting member 58 of slide member 52 is biased against the lamellas by a strong coil spring 72 encircling shaft 36 and located between the connecting member 58 and the inner surface of the housing side wall 18. The force exerted by the coil spring through the connecting member 58 against the lamellas 38 and discs 40 (pressing them against washer 71) compresses the lamellas and discs together. This locks them in position and therefore prevents movement of the chair seat or back (not shown). This condition of the lamellas is shown in FIGS. 3 and 4. The pressure of spring 72 in this condition can be adjusted by backing off, or tightening, nut 68 on shaft 38.

To release the pressure of connecting member 58 against the lamellas 38 and discs 40, the releasable lock 12 includes a camming mechanism. The camming mechanism includes a cam 76 (best shown in FIGS. 1 and 4 to 6) which has a front surface 77 consisting of a curved cam lobe 78 and a flat surface 80. Cam 76 also has flat parallel opposite side surfaces 81. The cam 36 includes an opening 82 extending therethrough, parallel to the front surface 77 and at right angles to side surfaces 81. A pivot shaft 84 extends through the opening 82 in the cam and through aligned openings 86 in the rails 54 adjacent their free ends 56, and is held in position by an enlarged head 88 and a conventional locking cap 90 (FIG. 6). A generally H-shaped wear plate 94 (best shown in FIG. 6) is fitted into the space between the rails 54, over the head 64 of shaft 36, so that the cam will press on the wear plate 94 (as shown in FIG. 3 to 5) rather than against the shaft head 64.

Figure 1:
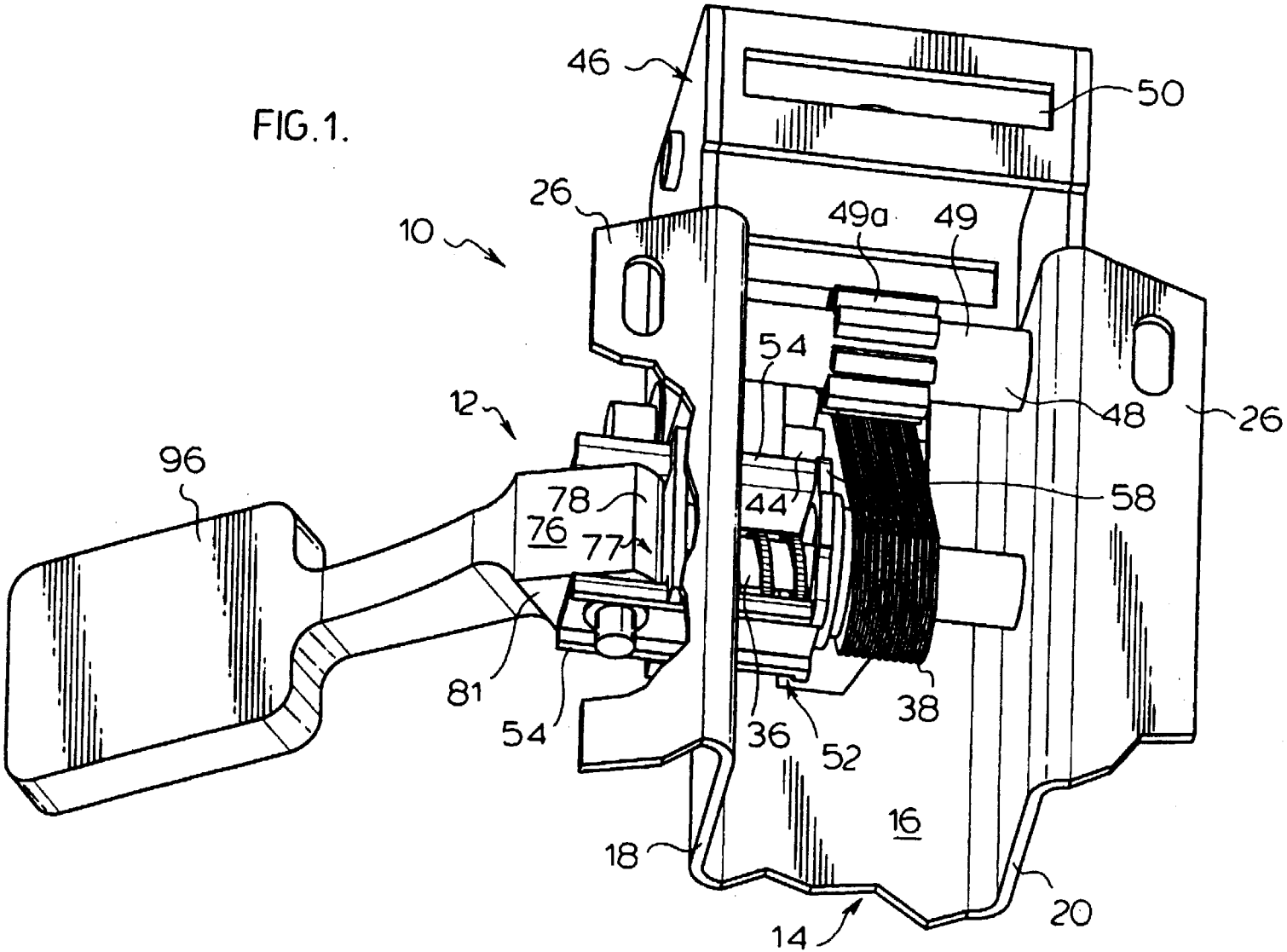
FIG. 1 is a perspective view, from above, of a preferred embodiment of a releasable lock in accordance with the invention, used with a conventional chair control mechanism.
Figure 1A:
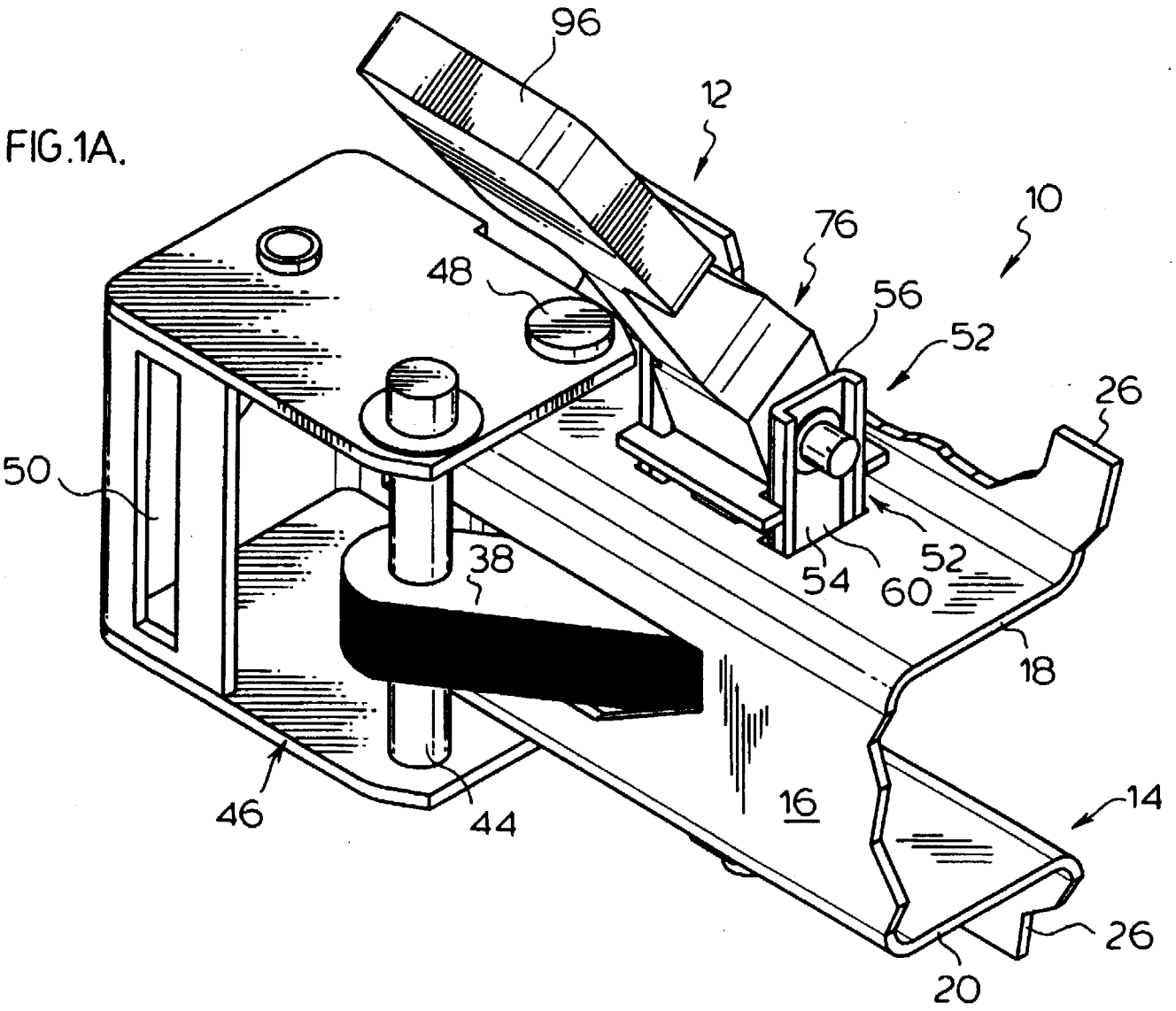
FIG. 1A is a perspective view, from below, of the mechanism of FIG. 1.
Figure 5:
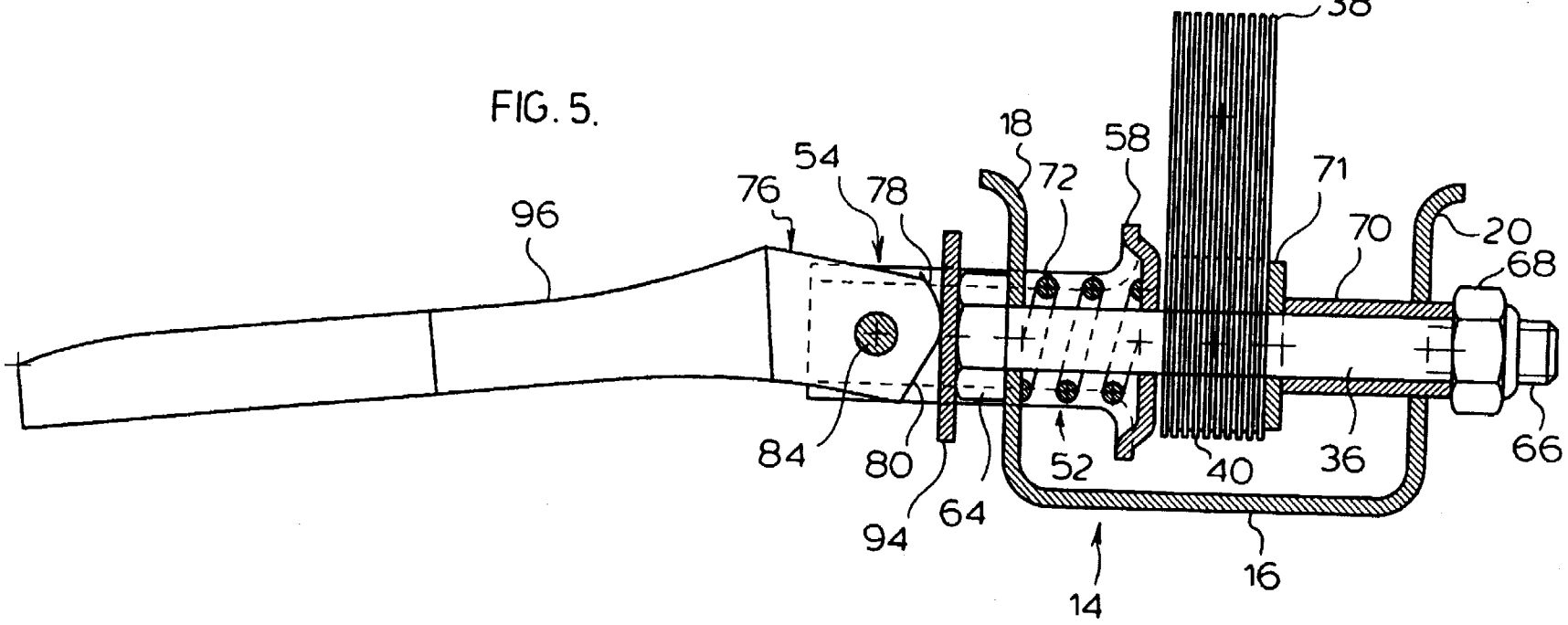
FIG. 5 is a cross-sectional view taken along lines 4—4 of FIG. 3 with the control mechanism in the released position.

In use, a shaft or handle 96 is connected to the cam 76 (typically the two are molded integrally of a strong plastic) so that the cam can be moved between the lamellas locked position shown in FIGS. 1 and 4, and the unlocked position shown in FIG. 5. In the unlocked position, which is with the handle 96 nearly horizontal as shown in FIG. 5, the cam lobe 78 presses against wear plate 94 and draws the slide member 52 outwardly (to the left in FIG. 5) through the slots 60 in side wall 18, pulling connecting member 58 away from the lamellas 38 and clutch discs 40. This allows the lamellas 38 and clutch discs 40 to move with respect to each other, permitting adjustment of the chair back.

To relock the lamellas, the handle 96 is moved downwardly, back to the position shown in FIGS. 1 and 4. Here, the flat front face 80 rests against the wear plate 94. Since the distance between the flat front face 80 and the pivot shaft 84 is less than the distance between the peak of the cam lobe 78 and the pivot shaft 84, this permits the slide member 54 to move inwardly into the housing 14, so that the connecting member 58 presses again against the lamellas 38 and discs 40, locking them against movement.

It will be seen that the preferred embodiment described differs substantially from prior lock mechanisms, in which there is usually a solid spring housing (normally welded to a side plate), and a movable clutch release push rod. With the present invention the center rod (shaft 36) is fixed relative to side wall 18, and the clutch is operated by a movable housing, thus reversing the previous function of these components. This permits the use of stamped metal parts (and molded plastic parts) and eliminates the need for welding, thus substantially lowering manufacturing costs.

While a preferred embodiment of the invention has been described, it will be appreciated that various changes may be made within the spirit of the invention, and such changes are intended to be within the scope of the appended claims.

I claim:

1. A chair control mechanism comprising:

(a) a housing, (b) a set of lamellas in said housing for connection to a chair part to allow selective movement of said chair part, said lamellas having aligned openings therein, (c) a shaft extending into said housing and through said openings in said lamellas, one end of said shaft being fixed relative to said housing, (d) a slide member slidable on said shaft and extending through said housing and having a first end adjacent said lamellas and a second end outside said housing, (e) said slide member being slidable on said shaft between a first position in which said first end applies pressure to compress said lamellas and a second position in which said first end is moved away from said lamellas to release the pressure on said lamellas, (f) biasing means biasing said slide member to said first position to compress said lamellas together, said biasing means located between said housing and said first end of said slide member, (g) and cam means connected to the second end of said slide member and operable to cam said slide member to said second position, to selectively lock and unlock said lamellas.

2. A chair control mechanism according to claim 1 wherein said slide member comprises a U-shaped bracket having a pair of legs, and a connecting member joining said legs adjacent said first end, said connecting member being biased against said lamellas.

3. A chair control mechanism according to claim 2 wherein said biasing means comprises a coil spring encircling said shaft and pressing against said connecting member.

4. A chair control mechanism according to claim 3 and including pivot means connecting said cam member between said legs at said second end of said slide member.

5. A chair control mechanism according to claim 4 and including a bearing plate mounted on said shaft outside said housing, said cam having a cam surface pressing against said bearing plate.

6. A chair control mechanism according to claim 5 wherein said cam surface has a curved cam lobe and a flat portion adjacent said cam lobe.

7. A chair control mechanism according to claim 6 and including a lever arm connected to said cam.

8. A chair control mechanism according to claim 3 wherein said housing is substantially channel shaped, having a web and a pair of spaced flanges connected to said web, said shaft extending through said flanges.

9. A chair control mechanism according to claim 8 and including a stop member mounted on said shaft and spaced from said connecting member, said lamellas being located between said stop and said connecting member.

10. A chair control mechanism according to claim 9 wherein said aligned openings in said lamellas are in the form of slots, to permit both translational and pivotal movement of said lamellas when said slide member is in said second position.

* * * * *